US005630483A

United States Patent [19]

Karner

[11] Patent Number: 5,630,483

[45] Date of Patent: May 20, 1997

[54] PROCEDURE AND APPARATUS FOR TRIGGERING THE SAFETY GEAR OF AN ELEVATOR

[75] Inventor: Franz J. Karner, Jessnitz, Austria

[73] Assignee: KONE Oy, Helsinki, Finland

[21] Appl. No.: 368,637

[22] Filed: Jan. 4, 1995

[30] Foreign Application Priority Data

Jan. 5, 1994 [FI] Finland ..... 940056

[51] Int. Cl.[6] ..... B66B 5/00

[52] U.S. Cl. ..... 187/350; 188/189

[58] Field of Search ..... 187/373, 374, 187/276, 287, 288, 289, 377, 350; 188/188, 189

[56] References Cited

U.S. PATENT DOCUMENTS

| | | | |
|---|---|---|---|
| 1,873,809 | 8/1932 | Baldwin | 187/287 |
| 4,531,617 | 7/1985 | Martin et al. | 187/373 |
| 4,653,612 | 3/1987 | Winkler . | |
| 4,662,481 | 5/1987 | Morris et al. | 187/373 |
| 5,492,200 | 2/1996 | Korhonen | 187/350 |

FOREIGN PATENT DOCUMENTS

| | | |
|---|---|---|
| 121711 | 2/1984 | European Pat. Off. . |
| 0628510 | 12/1994 | European Pat. Off. . |
| 1236153 | 3/1967 | Germany . |

*Primary Examiner*—Kenneth Noland

*Attorney, Agent, or Firm*—Birch, Stewart, Kolasch & Birch, LLP

[57] ABSTRACT

In this overspeed governor, an overspeed condition causes, by way of coupling elements (15,15'), a brake (5) comprised in the overspeed governor to engage a rope pulley (3) which, due to friction, brakes the rope driving the rope pulley itself and thus triggers the safety gear of the elevator. In the invention, the rotation of at least one coupling element (15,15') provided in the overspeed governor and rotating with it is braked by a frictional force which is applied to a braking point (31,32) on the coupling element (15,15'). The combined effect of the braking action and the rotation of the overspeed governor turns the coupling element (15,15') into a position in which the brake (5) is activated so as to engage the rope pulley (3).

20 Claims, 4 Drawing Sheets

PROCEDURE AND APPARATUS FOR TRIGGERING THE SAFETY GEAR OF AN ELEVATOR

FIELD OF THE INVENTION

The present invention relates to a procedure and an apparatus for the triggering of the safety gear of an elevator.

BACKGROUND OF THE INVENTION

Conventionally, elevators are provided with a safety gear which is triggered by an overspeed governor. In a common solution, when the elevator speed reaches a limit value preset in the overspeed governor, the overspeed governor triggers the safety gear by means of the same rope which transmits the elevator motion to the overspeed governor. The structure and operation of an overspeed governor of this type is described in U.S. Pat. No. 4,653,612.

In addition to overspeed situations, there are situations in which it should be possible to activate the safety gear of the elevator even if the elevator speed does not exceed the allowed limit. These situations include the testing of the safety gear in connection with the inspection of the elevator. For instance, certain elevators with a geared hoisting motor cannot normally be accelerated to the gripping speed, so checking the gripping function requires special measures. The usual solution for test operation in many overspeed governors is to provide the sheave with two rope grooves. The groove with the smaller diameter is intended for test situations. For a test, the driving rope is placed in this groove. Because of the change in the transmission ratio, this causes the overspeed governor to rotate faster than normally and the overspeed governor reaches the speed of rotation required for triggering the safety gear. A testing procedure like this takes plenty of working time. There are also possible fault situations in which it is necessary that the elevator can be stopped independently of the hoisting motor and working brake of the elevator. Such a fault situation is e.g. one in which the elevator starts moving from a floor with the doors completely or partially open.

At present, a further problem is that the overspeed governor has to be so placed that it can be accessed during inspection. If the elevator has a machine room, there is no problem, but in other solutions relating to the placement of the machinery, when the overspeed governor is placed in the elevator shaft, a separate inspection door is needed to allow the overspeed governor to be accessed in connection with an inspection.

The solutions proposed to solve the above-described problem include overspeed governor constructions in which a rotating part in the overspeed governor hits an obstacle brought into its path. The change in the postion or location of the rotating part resulting from the collision triggers the gripping function. For example, specifications DE B 1 236 153 and EP A 0 121 711 present solutions involving a collision between hard objects when an obstacle is brought into the path of a rotating part. The collision between the hard objects and the consequent requirement regarding a close mutual mounting tolerance between the colliding and rotating parts or alternatively a robust construction render overspeed governor constructions like those presented in the above-mentioned specifications expensive and/or problematic in operation.

SUMMARY OF THE INVENTION

To meet the need and to solve the problems described above, a procedure and an apparatus are presented.

With this invention, a simple and reliable solution for external triggering of the overspeed governor is achieved.

The invention is also applicable for use in overspeed governors operating in two directions. Moreover, the invention provides other advantages relating to remote triggering, including the following:

The invention enables the safety gear to be triggered at a speed below the gripping speed without requiring much work, making it easy to test the operation of the safety gear.

The invention can be used under the elevator control system to stop the elevator in danger situations below the gripping speed, e.g. when the elevator leaves a floor with doors open.

The invention is implemented with a simple structure.

The invention is applicable for use in an overspeed governor which is locked in the triggering position and which is only released from the locked state when it is rotated in the reverse direction; in other words, the invention does not require the overspeed governor or its triggering to be aligned separately, but the overspeed governor is reset at the same time when the elevator is released from the gripping condition.

A solution implemented according to the invention tolerates normal variations in dimensioning occurring in manufacture and does not require any extraordinary accuracy in installation or maintenance.

An overspeed governor according to the invention can be triggered by remote control and it can therefore be installed in the elevator shaft, on the ceiling or on the bottom, without requiring a separate inspection door.

In the following, the invention is described in detail by the aid of a few examples, which in themselves do not constitute a limitation of the invention. In the examples, the application of the invention is described in connection with an overspeed governor like the one described in U.S. Pat. No. 4,653,612.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

Below, reference is made to the attached drawings which are given by way of illustration only, and thus are not limitative of the present invention, and in which.

DESCRIPTION OF THE PREFERRED EMBODIMENT

Figure 1:
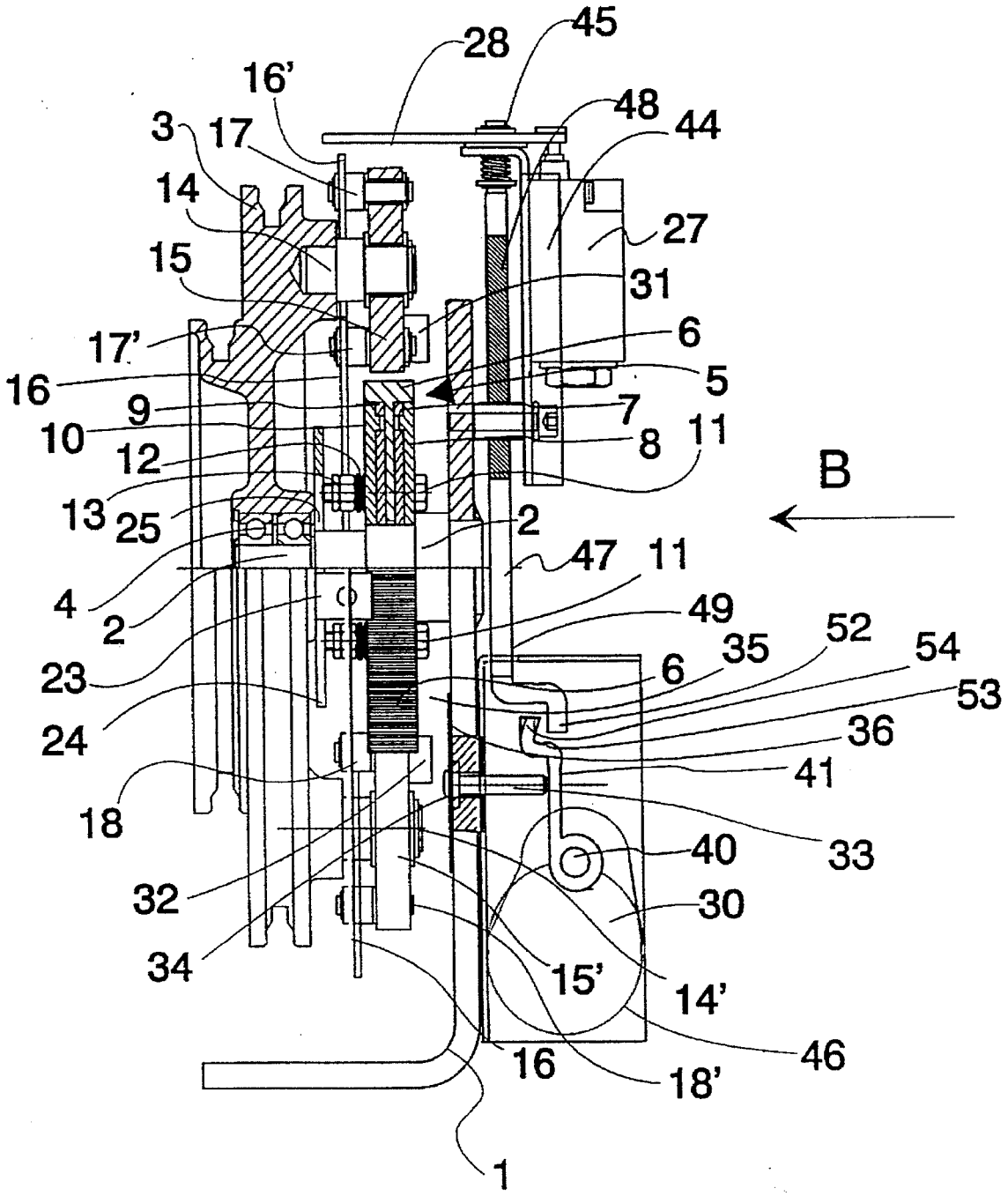
FIG. 1 presents an overspeed governor in which the invention is applied, seen in side view and partially sectioned along line A—A in FIG. 2.
Figure 2:
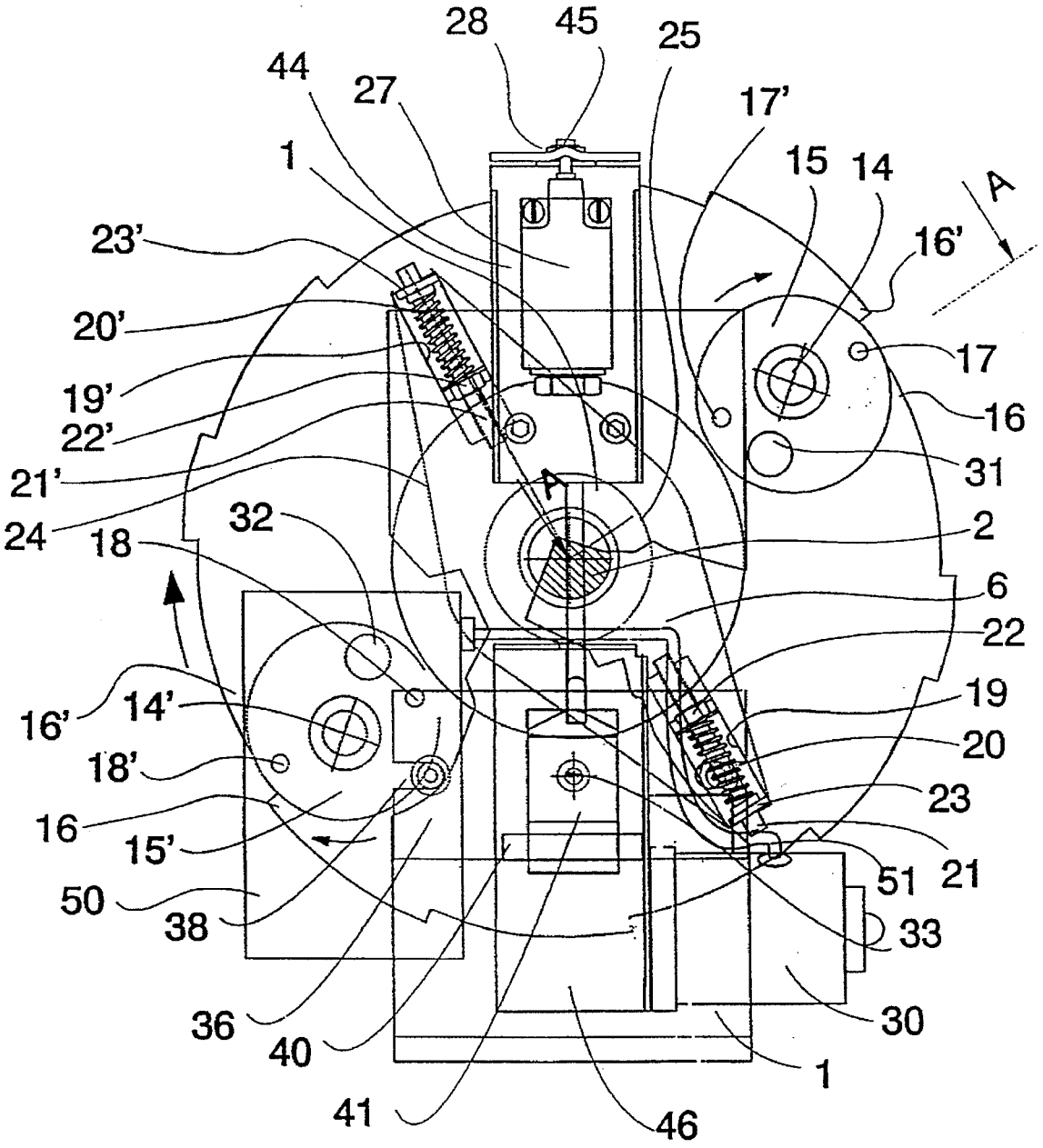
FIG. 2 presents the overspeed governor as seen from direction B in FIG. 1.

FIGS. 1 and 2 present an example illustrating the main features of an overspeed governor applying the invention.

Welded onto a support 1, partially sectioned in FIG. 2, is a shaft 2 which carries a rope pulley 3, which is mounted on the shaft by means of ball bearings 4. Mounted beside the rope pulley on the shaft is a brake 5, which consists of a brake disc 6 rotatable with respect to the shaft 2, a front plate 8 pressed against the brake disc 6 via brake clutches 7 and welded onto the shaft, and a back plate 10 similarly pressed against the brake disc 6 via brake clutches 9. Welded in the front plate 8 are key bolts 11 which go through the front plate 8 and back plate 10 and support disc springs 12 placed against the back plate 10. The disc springs 12 are pretensioned by means of adjusting nuts 13 screwed onto the key bolts 11. The adjusting nuts 13 are used to adjust the braking force applied to the brake disc by the two discs 8 and 10. The overspeed governor presented as an example can be regarded as being mainly a device rotating on the shaft 2 or a device most of whose parts are fitted to rotate about the shaft 2.

The rope pulley 3 supports two knuckle pins 14,14', placed diametrically opposite to each other on the side of the pulley facing towards the brake 5. Rotatably mounted on the knuckle pins 14,14 ' are two eccentric cams 15,15' placed above the brake disc 6 (i.e. outside the diameter of the brake disc) and acting as coupling elements. The eccentric cams are connected by two curved centrifugal weights 16,16' essentially symmetrical in shape. As seen from the direction of the shaft 2, the centrifugal weights together form a body resembling a split circular blare with a large opening in the middle for the shaft 2 and other parts. One end of each centrifugal weight 16,16' is turnably mounted on an eccentric bolt 17,17' on the first eccentric cam 15 and the other end on an eccentric bolt 18,18' on the second eccentric cam 15'. In the mass center area of each centrifugal weight 16,16' there is an opening 19,19' in which is placed a spring pin 21,21' carrying a counter spring 20,20' formed as a pressure spring. Screwed onto the spring pin 21,21' is an adjusting nut 22,22' protected with a stop plate against thread breakage. One end of the pressure spring 20,20' is retained by the adjusting nut 22,22' while the other end is retained by a lug 23,23' protruding from a spring holder 24 and extending to the opening 19,19'. The two lugs 23,23' are placed at opposite ends of the spring holder 24. The spring holder 24 is held in place by the spring pins 21,21' and the pressure springs 20,20'. The spring holder 24 is provided with a clearance 25 for the shaft 2 in the middle, permitting the spring holder to rotate with the centrifugal weights 16,16' without coming into contact with the shaft 2. The eccentric cams 15,15' are provided with protrusions 31,32 attached to the side facing the support 1, or the protrusions form part of the eccentric cams 15,15'. The protrusions 31,32 are preferably bodies made of rubber or some other elastic material and possibly cylindrical in shape, which are glued onto the eccentric cams. Attached to the support 1 is an electromotor 30 fitted to rotate a shaft 40. The electromotor 30 is preferably a geared d.c. motor, e.g. like the series 0226 (GMRG) motor manufactured by SWF. Fixed to the shaft 40 is a lever 41, which is immovable with respect to the shaft. Fitted in the support 1 is a plunger 33 which can pass through a hole 34 provided in the support. The hole 34 and the plunger 33 as well as the electromotor 30, the shaft 40 and the lever 41 actuated by it are so placed with respect to each other and the shaft 40 and the lever 41 are of such dimensions that, by rotating the electromotor 30, the plunger 33 can be driven in the hole 34 into the space 35 between the support 1 and the rotating parts of the overspeed governor. Preferably the plunger 33 and the hole 34 are so shaped relative to each other that the plunger 33 can only be removed from the hole in the direction towards space 35. However, the plunger 33 is prevented from coming off the hole 34 by a spring plate 36 mounted on the support 1 in a manner permitting some movement. Preferably the spring plate 36 is mounted by means of screws 37 placed in slots 39 at the ends 38 of the spring plate or alternatively in elongaged holes made in the spring plate. The screws 37 are locked in the support in a position which leaves a sufficient clearance between the support 1 and the head of the screw 37, said clearance exceeding the thickness of the spring plate and thus ensuring that the spring plate remains movable in its mounting in the direction of its plane. The amount of play of the spring plate 36 in the direction of its plane is determined by the placement of the retaining screws on the support and the mutual positions of the slots 39 in the spring plate 36. The amount of play of the spring plate 36 further depends on the thickness of the screws 37 and the size of the slots 39. When the motor 30 is driven in the direction opposite to that used when pushing the plunger 33 into space 35, the spring plate 36 acts as a return spring for the plunger 33. The plunger 33 touches the spring plate 36 at a point essentially at the middle of the spring plate. When, by operating the motor 30, the plunger 33 is driven in the hole 34 towards the space 35 between the support 1 and the rotating parts of the overspeed governor, the plunger 33 pushes the spring plate 36 before it. As the spring plate 36 is retained at its ends by the heads of the screws 37, the pushing force of the plunger 33 causes it to bend in its central portion towards the rotating parts of the overspeed governor. In other words, the spring plate 36 is pressed from one side by the plunger 33 until it touches one of the protrusions 31,32. The maximum range of movement of the plunger 33 into space 35 is smaller than that needed to push the spring plate 36 completely apart from its mounting and larger than the distance of the protrusions 31,32 from the spring plate surface facing towards space 35 as measured in the flat position of the spring.

The spring plate 36 is so mounted on the support 1 that the lengthwise direction of the spring plate, i.e. the line passing through the midpoints of the securing slots 39, is substantially parallel to the tangent of the path of the protrusion 31,32 attached to the side of the eccentric cam 15,15' when the protrusion 31,32 is in the position directly opposite the plunger 33. The distance of the plunger 33 from the shaft 2 and also the distance of the spring plate 36 from the shaft 2 are fitted to be substantially equal to the distance of the protrusion 31,32 from the shaft 2.

The arrows on the outer circles of the overspeed governor and eccentric cams 15,15' in FIG. 2 indicate the direction of rotation of the overspeed governor corresponding to the direction of elevator travel during gripping and the direction of rotation of the eccentric cams 15,15' corresponding to the acceleration of the elevator.

In an overspeed situation, the overspeed governor functions as follows. Placed on the outer edge of the centrifugal weights 16,16' are tripping cams which, by means of a switching arm, interact with a switch 27 mounted on the support. The switching arm 28 is placed outside the diameter of the orbit of the centrifugal weights 16,16' When a certain speed of rotation is exceeded, the switch 27 disconnects the operating power as soon as the centrifugal weights 16,16' spread and cause the switching arm 28 to be turned by the tripping cams. This rotational speed is lower than the speed which triggers the gripping action When the set triggering speed is exceeded, the eccentric cams 15,15' are turned by the centrifugal weights 16,16' far enough to cause their eccentric rim to engage the rim of the brake disc 6, where-upon the brake 5 will brake the rope pulley 3 via the eccentric cams 15,15'. Via the rope pulley 3, the rope driving the pulley itself is braked as well, and thus the safety gear of the elevator is triggered.

The switch 27 is attached to the support 1 by means of a mounting 44. The switching arm 28 is turnably mounted on the mounting 44 by means of a bearing part 45. When the cams of the centrifugal weights 16,16' have turned the switching arm 28 away from its middle position, the supply of driving power to the elevator remains switched off until the switching arm 28 is again returned to the middle position. In other words, every time when the supply of operating power to the elevator has been switched off by the switch 27, the switch 27 has to be reset to enable the elevator to be started again. Attached to the switching arm 28 is a crank-like turn bar serving as a resetting part 47. One end of the resetting part 47 is mounted essentially coaxially with the bearing part 45. At its other end 52, the resetting part is passed through a hole 49 in the motor support 46 and has at this other end 52 a crank-like shape, preferably with two bends of essentially equal magnitude, preferably about 90 degrees, turning in opposite directions. Even a single bend, e.g. about 45 degrees, would be sufficient for operation, although in practice it would produce axial forces in the bearing part 45. The resetting part 47 is retained radially in place by the bearing part 45 and the hole 49. The resetting part 47 is preferably partially flexible, which is achieved by fitting a flexible coupling element 48 in that portion of the length of the resetting part 47 which goes between the bearing part 45 and the hole 49. The resetting part can be provided with a coupling element 48 e.g. by forming part of the length of the resetting part 47 from a metal wire plexus or other material which has a degree of flexibility but is still substantially and therefore sufficiently rigid against torsion to enable the switching arm 28 to be turned. The rotation axis of the switching arm 28 is essentially coaxial with the rotation axis of the resetting part 47 attached to it. In respect of technical manufacturing requirements, the flexible coupling element 48 allows a sufficient mismatching in the coaxial fit between the rotation axis of the switching arm 28 and that of the resetting part 47.

The rotation axis of the resetting part 47 is substantially parallel to a plane perpendicular to the shaft 40 which turns the lever 41. The resetting part 47 is preferably so coupled with the switching arm 28 that, when the switching arm 28 is in its middle position, the resetting part 47 with its bends at the lower end 52 lies in a plane perpendicular to the shaft 40. The end 53 of the lever 41 is provided with a slot 54, preferably V-shaped. The mutual positions of the slot 54 and the end 52 of the resetting part are so fitted that, when the switching arm 28 is in its middle position, the end 52 of the resetting part hits the bottom of the V-shaped slot when the lever 41 is turned to a position where the slot 54 meets the end 52 of the resetting part. The shape and dimensions of the end 52 of the resetting part 47 are so selected relative to the dimensions of the slot 54 that, regardless of the position to which the resetting part has been turned by the switching arm 28 as a result of the action of the coupling cams placed on the periphery of the centrifugal weights 16,16', the end 52 of the resetting part always goes into the slot 54 when the lever 41 is turned so that it meets the resetting part 47. The range of the rotational motion of the switching arm 28 and the resetting part 47 coupled with it can be limited to a maximum rotational range value as appropriate with regard to ensuring proper operation of the switch 27. The structural parts used to limit the rotational motion are not presented in the figures. When the slot 54 in the lever 41 is pressed against the end 52 of the resetting part, the supporting forces resulting from the V-shape of the slot cause the end 52 to be centered on the bottom of the V-shaped slot, thus returning the switching arm 28 by means of the resetting part 47 to its middle position. Due to the flexible coupling element 48, the resetting part 47 is prevented from getting stuck during the movement. The lever 41, the end 52 of the resetting part and the plunger 33 are so positioned with respect to each other that the plunger 33 lies on one side of the lever 41 while the end 52 lies on the other side of the lever 41. The allowed extreme position of the plunger 33 when pressed towards space 35 and the position of the end 52 of the crank-like resetting part correspond to the extremities of the movement of the lever 41. The movement of the lever 41 is limited to the sector between these two extreme positions.

When the overspeed governor is to be triggered into action by a cause other than the centrifugal force, forced triggering can be implemeted using remote control, in which case the following will occur: Turned by the motor 30, the lever presses the plunger 33, which in turn presses the spring plate 36, causing it to bend towards the gap 35 between the support 1 and the rotating parts, in the first place the eccentric cams 15,15', of the overspeed governor. As the elevator is moving, and the overspeed governor is rotating, one of the eccentric cams 15,15' will reach the plunger and the protrusion 31,32 on the eccentric cam will hit the spring plate 36, which has been bent towards space 35. Due to its movement, the protrusion 31,32 tends to slide along the curved spring plate 36. In this situation, however, the supporting force applied by the spring plate 36 to the protrusion 31,32 brakes the movement of the protrusion 31,32 due to friction. Since the protrusions 31,32 are attached to the eccentric cams 15,15', which are turnably mounted on the knuckle pins 14,14' and centrifugal weights 16,16' the braking force applied to the protrusion 31,32 causes the eccentric cam 15,15' to turn into a position in which the centrifugal weights 16,16' move into the orbit corresponding to the gripping speed and indirectly also turns the opposite eccentric cam so that it meets the brake disc. To improve the engagement between the eccentric cams 15,15' and the brake disc 6, their rims can be roughened or jagged or provided with a coating. The area o engagement of the eccentric cams 15,15' can be limited for example by means of a bolt placed at the edge of the cams 15,15'

To return the switching arm 28 to its middle position, in other words to reset the switch 27 into a state that again permits the supply of operating power to the elevator motor, the motor 30 is driven in the direction reverse to that used to press the plunger 33. The slot 54 in the lever 41 is pressed against the end 52 of the resetting part, applying to it a force that, with the movement, centers the end 52 to the center of the slot. As the resetting part 47 has a crank-like shape and is turnably mounted in the hole 49 and in the bearing part, the switching arm 28 is turned into the middle position and the switch 27 is reset.

The motor 30 is operated by means of a motor controller 50. The controller supplies the operating power needed by the motor via a cable 51. At the same time, the motor is given control data determining the direction and speed of its rotation. When the plunger 33 is to be pressed in, a simple control method is to operate the motor 30 for a preset length of time which is positively sufficient to drive the plunger into the desired depth. The plunger is prevented from going too far in by limiting the maximum lever movement to the value required for driving the plunger into the desired depth. Correspondingly, to return the plunger into its rest position, the motor is driven in the reverse direction for a certain length of time, preset for this purpose. The resetting of the switch 27 is also performed by operating the motor 30. The motor is driven by means of the controller 50 in the direction reverse to that used to press the plunger 33. A simple and advantageous control method is to operate the motor 30 for a preset length of time which is positively sufficient to reset the switch 27. The operating commands to the motor controller 50 are issued through the elevator control system or through a separate operator interface.

In this way, by means of a spring plate 36 or other suitable element attached to the support 1 of the overspeed governor, a supporting force is applied to at least one of the protrusions 31,32 of the coupling elements 15,15' comprised in the overspeed governor or to a point functionally corresponding to such a protrusion, a force substantially perpendicular to the direction of motion of said point. This supporting force is fitted to be such that the frictional force it generates between the spring plate 36 and the protrusion 31,32 together with the supporting force at the point of attachment 14,14' of the coupling element 15,15' forms a force couple sufficient to turn the coupling element 15,15' to the position in which the braking of the rope pulley 3 is started. The protrusions 31,32 in the coupling elements 15,15' of the overspeed governor and the spring plate 36 attached to the support 1 engage each other in such a way that the direction of the contact surface between them is essentially the same as the direction of motion of the protrusions 31,32 substantially over the entire contact surface.

Figure 4:
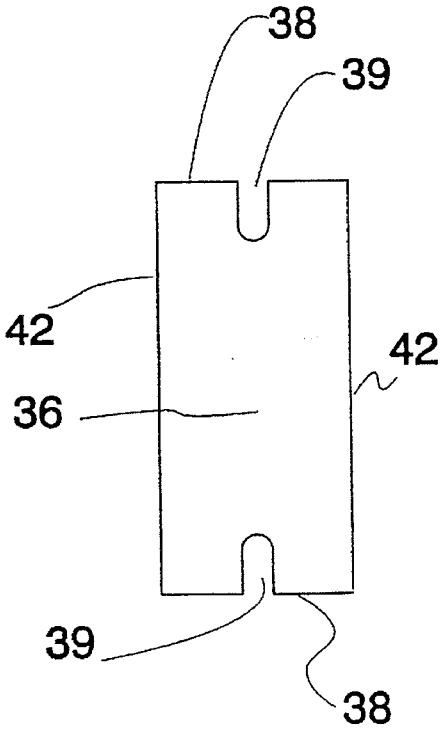
FIG. 4 presents a spring plate used in the overspeed governor.

FIG. 4 presents a preferred form of the spring plate 36. The spring plate 36 is made from a substantially planar flexible plate. The ends of the spring plate 36 are provided with mounting slots 39. The sides of the spring plate 36 can be straight. The spring plate 36 is preferably a substantially rectangular body and its length, i.e. the length of sides 42, is of the order of the width of the support 1 and its width, i.e. the length of side 39, is about the same as or somewhat larger than the range of variation of the distance of the protrusion 32 from the shaft 2 plus the diameter of the protrusion.

Figure 3:
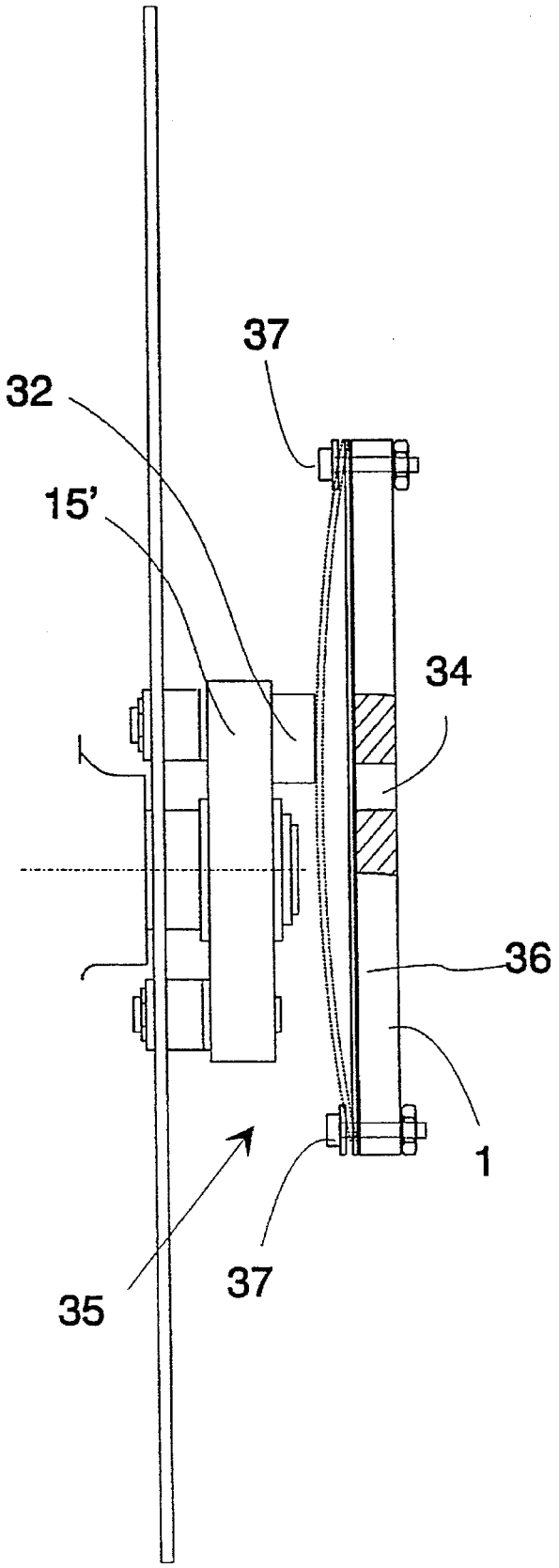
FIG. 3 presents a detail of the overspeed governor.

FIG. 3 presents a detail of the overspeed governor, showing more clearly how the spring plate 36 bends to meet the protrusion 32 of an eccentric cam 15' The bent spring plate 36 is depicted with broken lines. To bend the spring plate 36, a pressure is applied to it through the hole 34. The pressing means is not shown in FIG. 3. The spring plate 36 is retained by its ends under the heads of the screws which attach it to the support. When bent out towards space 35, the spring plate 36 hits the protrusion 32 of an eccentric cam 15,15' and thus brakes the motion of the protrusion 32.

When, by operating the motor 30, the plunger 33 is driven in the hole 34 towards the space 35 between the support 1 and the rotating parts of the overspeed governor, the plunger 33 pushes the spring plate 36 before it. Due to the pushing action of the plunger 33, the spring plate is bent at its middle towards the rotating parts of the overspeed governor. The maximum range of movement of the plunger 33 into space 35 is smaller than that needed to push the spring plate 36 completely apart from its mounting and larger than the distance of the protrusions 31,32 from the spring plate surface facing towards space 35 as measured in the flat position of the spring.

Figure 5:
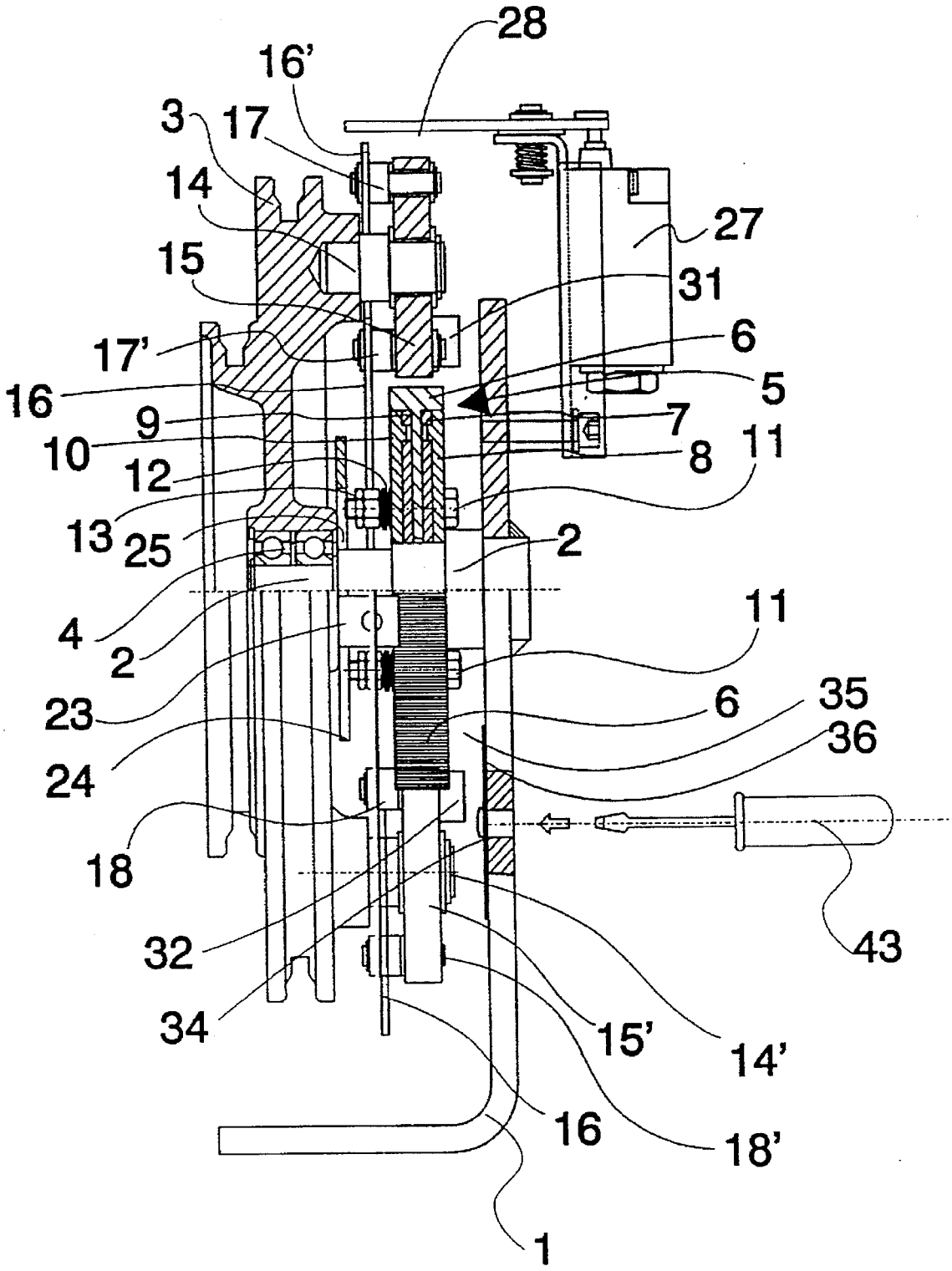
FIG. 5 presents an overspeed governor in which test operation is initiated by means of a tool, e.g. screw driver.

FIG. 5 presents an overspeed governor which can be actuated manually to initiate gripping. The structure of this overspeed governor differs from the one in FIG. 1 in that it does not include a motor which could be used as an actuator for remote triggering of the overspeed governor. Furthermore, this overspeed governor has no mechanism for resetting the switching arm 28 by means of a motor. In other respects, as regards structure and operation, the overspeed governor in FIG. 5 is like the one in FIG. 1 described above. In the overspeed governor in FIG. 5, the bending of the spring plate 36 to engage a protrusion 32 is accomplished by pressing the spring plate 36 by means of a tool 43, such as a screw driver, inserted through the hole 34 in the support 1. The tool may also be one specifically designed for this purpose.

For instance, it can be a plunger like the one 33 in FIG. 1 which is placed in the hole 34 in the support 1 and whose one end is shaped like a push button while the other end is pressed against the spring plate 36.

The overspeed governor apparatus need not be especially strong in construction as regards the controlled stopping function because the remote triggering does not involve any hard impact between moving parts of the overspeed governor, but the protrusion 31,32 is baked down from its motion over a relatively long distance, even tens of millimeters. Therefore, no sudden violent shock forces are produced in the structure nor does the apparatus cause recoil of any part which might result from a hard impact and which could throw back the rotating part too soon from the position in which the brake is engaged.

The brake 5 may also have a different design as regards its construction and operation, e.g. one in which the coupling elements engage a non-rotating part immovable with respect to the support 1 and in which the mutually opposite contact surfaces of this non-rotating immovable part and the coupling element act as braking surfaces of the brake.

It is obvious to a person skilled in the art that different embodiments of the invention are not restricted to the examples described above, but that they may instead be varied within the scope of the claims presented below. Instead of a rubber protrusion, other materials and/or structures can be used. It is also obvious that instead of using a spring plate as described in the example, the braking could be effected by using a curved or straight ramp attached to the end of the plunger, in which case the ramp would be pushed by the plunger into contact with the protrusion or directly with the eccentric cam.

It is further obvious to the skilled person that the protrusion used as a brake clutch need not necessarily be made of an elastic material, even though an elastic material gives a better contact between the protrusion and the spring plate. It is no less obvious that the coupling element need not have the shape of an eccentric disc as in the examples.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A procedure for triggering a safety gear of an elevator at a speed lower than a gripping speed of the elevator using an overspeed governor, the overspeed governor having coupling elements for causing an overspeed condition wherein a brake of the overspeed governor engages a rope pulley and due to friction brakes a rope driving the rope pulley, at least one coupling element having a braking point being provided on the overspeed governor, the at least one coupling element being rotatable with the overspeed governor, the procedure comprising the steps of:

rotating the braking point with the at least one coupling element as the overspeed governor rotates;

frictionally engaging an outer face of the braking point with a braking element, the outer face of the braking point facing the braking element; and turning the at least one coupling element upon subsequent rotation of the overspeed governor after the step of frictionally engaging to thereby move the coupling element to a position to activate the brake to engage the rope pulley.

2. The procedure according to claim 1, wherein the step of frictionally engaging comprises the step of pressing the braking element against the braking point of the at least one coupling element.

3. The procedure according to claim 2, wherein the step of pressing the braking element comprises moving the braking element from a non-engaging position to an engaging position with the braking point.

4. The procedure according to claim 1, further comprising the step of using a power device operated in accordance with a control signal to press the braking element into frictional engagement with the braking point, the power device comprising a geared electromotor.

5. The procedure according to claim 1, wherein the outer face of the braking point is on the at least one coupling element on a side of the overspeed governor opposite to a side of the overspeed governor facing the rope pulley and wherein the step of frictionally engaging comprises moving the braking element into engagement with the braking element.

6. The procedure according to claim 1, wherein the overspeed governor with the at least one coupling element and the braking point are rotatable in a generally planar area and wherein the step of frictionally engaging comprises moving the braking element to engage an edge of the planar area while generally preventing the braking element from protruding into the planar area.

7. The procedure according to claim 1, wherein two coupling elements are provided as the at least one coupling element and wherein braking points are provided on each of the coupling elements, the step of rotating the braking points comprises simultaneously rotating the two coupling elements and the braking points.

8. The procedure according to claim 1, wherein the step of frictionally engaging comprises moving a spring plate into engagement with the outer face of the braking point.

9. The procedure according to claim 8, wherein the step of moving the spring plate comprises pushing on a central portion of the plate to deflect the spring plate to thereby move the spring plate into engagement with the outer face of the braking point.

10. Apparatus for triggering a safety gear of an elevator at a speed lower than a gripping speed of the elevator using an overspeed governor, the overspeed governor having coupling elements for causing an overspeed condition wherein a brake of the overspeed governor engages a rope pulley and due to friction brakes a rope driving the rope pulley, the apparatus comprising:

a braking point on at least one coupling element of the overspeed governor, the braking point being movable with the coupling elements and having an outer face; and a braking element for frictionally engaging the outer face of the braking point to brake motion of the braking point whereafter subsequent rotation of the overspeed governor turns the coupling element to a position to activate the brake to engage the rope pulley, the outer face of the braking point facing the braking element.

11. The apparatus according to claim 10 further comprising power means operated in accordance with a control signal for actuating the braking element.

12. The apparatus according to claim 11, wherein the power means is an electromotor.

13. The apparatus according to claim 10, wherein the braking element comprises a spring plate movable to engage the outer face of the braking point.

14. The apparatus according to claim 13, wherein the spring plate is attached by ends thereof to a non-rotating part of the overspeed governor and wherein the apparatus further comprises power means for engaging and deflecting the spring plate into engagement with the braking point.

15. The apparatus according to claim 14, wherein the power means pushes on a central portion of the spring plate.

16. The apparatus according to claim 10, wherein the braking point comprises a protrusion extending from the at least one coupling element toward the braking element, the braking point being made of rubber or other elastic material.

17. The apparatus according to claim 16, wherein two coupling elements are provided in the overspeed governor and wherein each of the coupling elements has a braking point formed by a protrusion extending toward the braking element.

18. The apparatus according to claim 17, wherein the braking element comprises a spring plate movable to engage one of the outer faces of the protrusions of the braking points.

19. The apparatus according to claim 10, wherein the outer face of the braking point is on the at least one coupling element on a side of the overspeed governor opposite to a side of the overspeed governor facing the rope pulley.

20. The apparatus according to claim 10, wherein the at least one coupling element and the braking point are rotatable in a generally planar area and wherein the braking element generally fails to protrude into the planar area but engages an edge of the planar area when engaging the outer face of the braking point.

* * * * *